US005178071A

United States Patent [19]

Hyllberg

[11] Patent Number: 5,178,071

[45] Date of Patent: Jan. 12, 1993

[54] IMPRESSION ROLLER AND METHOD OF PREPARATION

[75] Inventor: Bruce E. Hyllberg, Gurnee, Ill.

[73] Assignee: American Roller Company, Union Grove, Wis.

[21] Appl. No.: 824,677

[22] Filed: Jan. 23, 1992

[51] Int. Cl.[5] ..... B41M 1/00; B41F 9/00

[52] U.S. Cl. ..... 101/489; 101/153; 101/DIG. 37

[58] Field of Search ..... 101/152, 153, 170, 212, 101/216, 219, 489, DIG. 37; 439/13, 18, 20, 23-25, 28; 29/121.1, 130

[56] References Cited

U.S. PATENT DOCUMENTS

| | | | |
|---|---|---|---|
| 4,364,313 | 12/1982 | Hyllberg | 101/153 |
| 4,513,660 | 4/1985 | Brands et al. | 101/219 |
| 4,539,908 | 9/1985 | Spengler | 101/153 |
| 4,966,555 | 10/1990 | Zagorski | 101/153 |
| 5,044,275 | 9/1991 | Knopf et al. | 101/153 |

OTHER PUBLICATIONS

The Eltex brochure dated May 10, 1990.

*Primary Examiner*—Edgar S. Burr
*Assistant Examiner*—Ren Yan
*Attorney, Agent, or Firm*—Quarles & Brady

[57] ABSTRACT

An impression roller for an electostatic printing assist system consists of a metal roller core, a relatively thick insulating layer of substantially uniform thickness covering the main body of the core, a relatively thin intermediate conductive layer covering the insulating layer and a relatively thick semiconductive layer covering the intermediate layer. The relatively thin conductive layer is exposed at one end of the roller so it can make contact with a rotary transformer. In a first embodiment of the invention the roller core is tapered at one end and the slope of the tapered end built up with semiconductive material. In a second embodiment there is an annular groove which is cut into the conductive layer to provide improved contact with a transformer. A method of preparing rollers is also disclosed.

8 Claims, 3 Drawing Sheets

IMPRESSION ROLLER AND METHOD OF PREPARATION

FIELD OF THE INVENTION

The present invention relates to an impression roller, also known as a counter pressure cylinder, for an electronically assisted printing machine. More particularly, it relates to a unique impression roller or counter pressure cylinder for use in a new type of electrostatic printing assist system and a method of preparing such a roller.

BACKGROUND OF THE INVENTION

Printing machines have been developed in which the transfer of ink to a web of material, such as paper, is not only provided by direct transfer of ink from an engraved cylinder, but also by electrostatic attraction of ink to the web. This is accomplished by passing the web through a nip region where the underside of the web is contacted by the engraved cylinder as it is being pressed down against the cylinder by an impression roller. Transfer of the ink is assisted by applying an electrical voltage to the impression roller in the nip region in a pattern determined by the engraved cylinder.

Impression rollers have typically been formed around a steel core that is grounded and insulated from a semiconductive layer that is formed on the exterior of the roller to conduct current to the nip region. The materials used in the outer layer of the impression roller exhibits the resistance of a semiconductor, and is also resilient, which allows for flattening of the outer surface of the impression roller in the nip region.

In the Knopf, et. al U.S. Pat. No. 5,044,275 a new electrostatic printing assist system is disclosed in which a rotary step-up transformer is attached to one end of the impression roller.

The new system consists of a low voltage D.C. power supply with appropriate controls for voltage, current, and safety; a step-up transformer, and a contact assembly to the impression roller. The design is unique in that the rotary step-up transformer is doughnut shaped and split into two pieces. The input side of the transformer is stationary and mounted to the gravure printing press. The output side is attached to the impression roller. A low voltage of about 100 to 200 volts is brought to the output transformer. As a safety feature, the high voltage (approximately a factor of 10 higher) exists only on the impression roller. The high voltage is rectified and filtered inside the output assembly on the impression roller, then fed by a special contact assembly to the middle layer of a three-layer impression roller.

In a normal three-layer impression roller, the first layer (base layer) on the steel core is an electrical insulator, the next layer (middle layer) is a low resistance material that is usually 10^4 ohm-cm or less in volume resistivity, and the top layer (surface layer) is a semiconductor in the 10^7 to 10^8 ohm-cm range. The middle layer which should be as thin as practical for roller stability provides a low resistance path and is usually encapsulated within the other two layers as a safety measure. The new system requires that the middle layer be exposed on one end of the roller so it can mate with the contact assembly.

The manufacturer's dimensional specifications for the base and middle layers on the end of the impression roller with the middle layer exposed are difficult to meet with normal rubber roller fabrication techniques. According to the manufacturer specifications, the base layer should be about 4.0 mm thick +/−0.1 mm, and the middle layer about 3.0 mm +/−0.1 mm. The ring formed by the middle conductive layer must also be concentric with the axis of the roller core. These dimensions were believed to be necessary to insure proper alignment and connection to the contact assembly, and that the middle layer is both electrically isolated from the core and contained within the outer dimension of the contact assembly housing. However, roller stability and life could be improved by making the intermediate conductive layer thinner.

In normal roller fabrication, the rubber is applied to the core in layers of calendered rubber each having a thickness of about one to two millimeters. Because the rubber is applied as a spiral layer, it is somewhat eccentric around the axis of the core. Also, when the roller is vulcanized and there is a certain amount of rubber flow (movement) that takes place that further distorts the thickness, uniformity, and concentricity of the different layers. As a result, it is difficult to prepare a conventional impression roller with a relatively thin intermediate conductive layer that still meets the requirements for use in the Knopf et al. patented system.

SUMMARY OF THE INVENTION

It is an object of the present invention to disclose a unique impression roller for use in an electrostatic printing system of the type shown in U.S. Pat. No. 5,044,275.

It is another object of the invention to provide a method of roller construction that will be useful in preparing rollers for use in various applications and systems employing a rotary transformer, for example, electrostatic printing and copying.

In a first embodiment, the impression roller of the present invention comprises a metallic core tapered at only one end, an insulating layer of substantially uniform thickness covering the core, a relatively thin intermediate conductive layer of substantially uniform thickness over the insulating layer, said conductive layer being exposed at the tapered end of the core, and a semiconductive outer layer completely covering the intermediate layer, said outer layer being thicker over the tapered end of the core.

In a second embodiment, the impression roller comprises a metallic core of uniform diameter, a relatively thick insulating layer covering the core, a relatively thin conductive layer over the insulating layer and a relatively thick semiconductive layer. In this embodiment, the end of the roller which is to contact the transformer has an annual groove which is cut into the conductive layer and filled with an insert of electroconductive rubber which is thicker than the conductive layer.

The first embodiment of the impression roller of the present invention is made by covering the main body and the tapered end of a roller core with an insulating layer of substantially uniform thickness; the insulating layer over the main body and the tapered end of the core is then covered with a relatively thin flexible conductive layer and the conductive layer at the tapered end of the core is covered and built up with semiconductive material to provide a roller of uniform diameter; and, the intermediate layer on the main body and the built up area of the tapered end are covered with a substantially uniform layer of semiconductive material. The roller is then trimmed and cured to obtain a finished roller with an exposed conductive layer at the end having the tapered core. If desired, an annular groove can be cut into the conductive layer at the built up end of the roller and filled with an insert of electroconductive rubber which is thicker than the conductive layer and serves as an improved contact for the rotary transformer.

In making the second embodiment of the impression roller of the present invention, an untapered metallic core is covered with a relatively thick insulating layer; a relatively thin conductive layer is placed over the insulating layer; a relatively thick semiconductive layer is placed over the conductive layer; an annular groove is cut into the conductive layer; and the groove is filled with an electroconductive rubber insert which is thicker than the conductive layer to provide an improved contact for the rotary transformer.

The foregoing and other objects and advantages of the invention will appear from the following description in which reference is made to the accompanying drawings to form a part hereof, and in which there is shown by way of illustration preferred embodiments of the invention. These embodiments do not necessarily represent the full scope of the invention, however, and therefore reference is made to the appended claims for interpreting the scope of the invention.

DESCRIPTION OF THE PREFERRED EMBODIMENT

An impression roller of the present invention may be employed in an electrostatic printing assist system of the type disclosed in the Knopf et al, U.S. Pat. No. 5,044,275, which is incorporated by reference herein.

Figure 1:
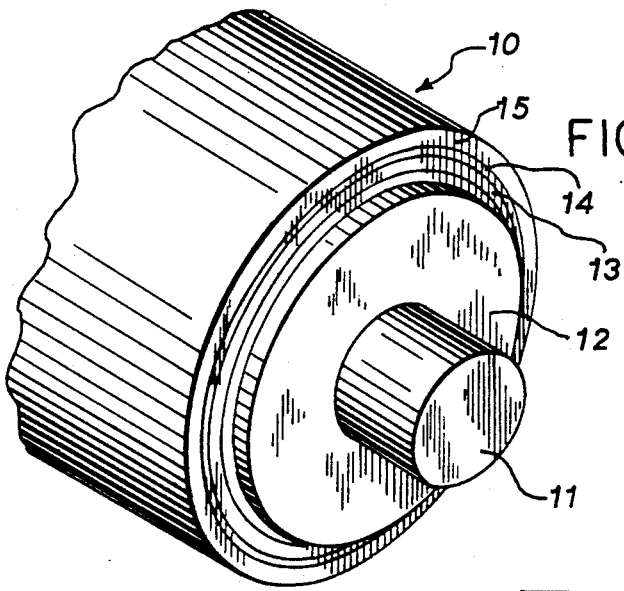
FIG. 1 is a partial view, of one end of a first embodiment of an impression roller of the present invention.

Referring to FIG. 1, one end of a first embodiment of an impression roller 10 is seen which has a shaft 11 and a tubular core 12, both preferably made of metal. As seen therein, the core 12 is covered with a relatively thick inner layer 13 of insulating material, an relatively thin intermediate layer 14 of conductive material and a relatively thick outer layer 15 of semiconductive material.

The insulating material of the inner layer 13 is preferably either a natural or synthetic rubber or a mixture of these. However, other known insulating materials can also be used.

The preferred material of intermediate conductive layer 14 is a low resistance material that is usually $10^4$ ohm-cm or less in volume resistivity. The material may be natural or synthetic rubber containing conductive carbon black or other conductive materials.

The preferred material for the outer semiconductive layer 15 is resilient and has an electrical resistivity in a range from $10^7$ ohm-centimeters to $10^8$ ohm-centimeters and a relative hardness in the range from 60–95 according to the Shore A scale. A chlorinated synthetic elastomer such as epichlorohydrin is suitable for use in forming the semiconductive layer 15. In addition, other semiconductive materials, including natural or synthetic materials, that exhibit the above described electrical characteristics, can also be employed. Furthermore, while resilient materials are preferred, in some applications non-resilient materials can also be used.

As seen in FIG. 1, there is a single layer 15 on the end of the roller shown. However, the layer 15 would be made up of a plurality of layers depending upon the taper of the core at that end of the roller 10. The other end of the roller 10 would have a single layer 15.

The preferred method of preparing a roller 10 of the present invention is shown in FIGS. 2–11 in which for convenience only part of the end of the roller 10 having the tapered core end **12*a*** is shown.

Figure 2:
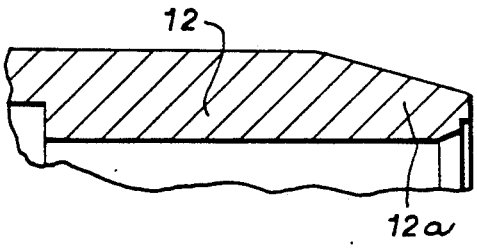
FIGS. 2 to 11 are partial views which illustrate the method of preparing the first embodiment of the impression roller of the present invention.

In FIG. 2, the core 12 is shown ready for covering after the bonding agents (not shown) have been applied.

Figure 3:
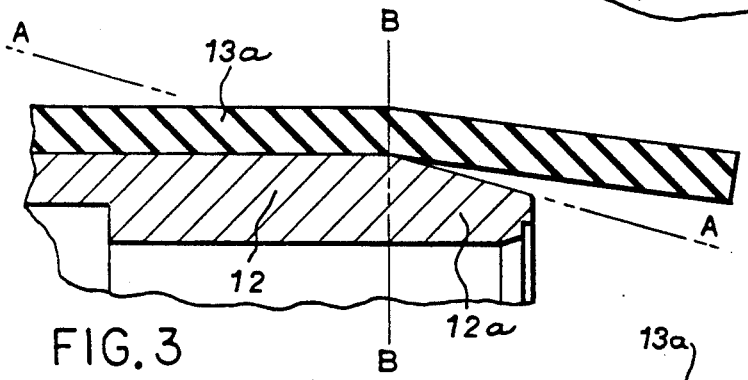
Figure 4:
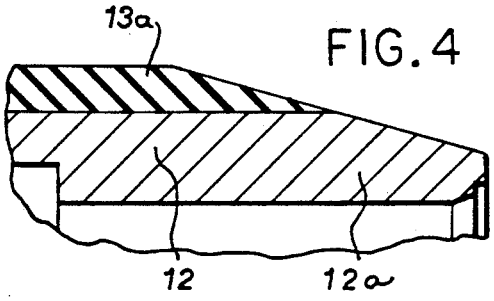

In FIGS. 3 and 4 a layer **13*a* of an insulating material is seen covering to the main body of the core 12 to a thickness of about 6.5 mm (¼+ inch). This thickness insures that the insulator spec of 1000 meg-ohms minimum is met. The layer 13*a*** is then trimmed along line A and not line B.

Figure 5:
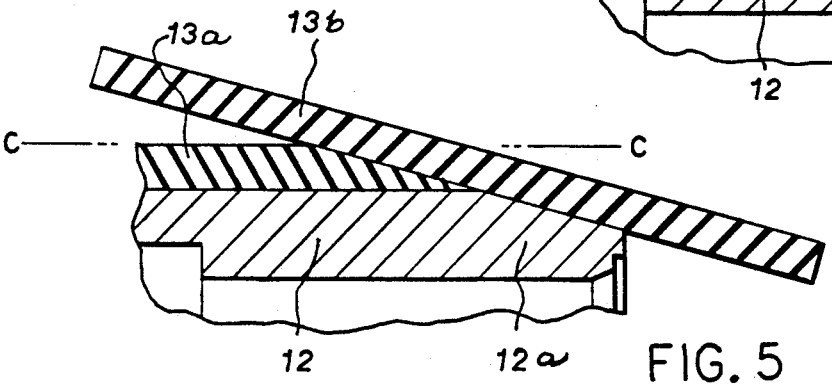
Figure 6:
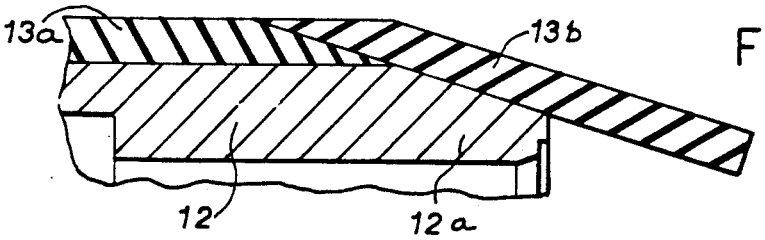

In FIGS. 5 and 6 a layer **13*b* of the insulating material is seen covering to the slope area of the tapered end 12*a* of the core 12 to a thickness between approximately 4.0 to 5.5 mm. It is then trimmed along line C. As a result, the entire core 12 is covered with a substantially uniform insulating base layer 13. The total specification thickness of the base layer 13 and the intermediate layer 14 is about 7.0 mm. The base layer thickness in this area is selected so that it will not be less than 4.0 mm and the sum of the base and intermediate layers will not exceed 7.0 mm (assuming one layer) of conductive middle material is no more than 1.5 mm thick). This will place a single sheet of conductive material within the 3.0 mm wide window of the manufacturers specifications for the middle conductive layer 14**.

Figure 7:
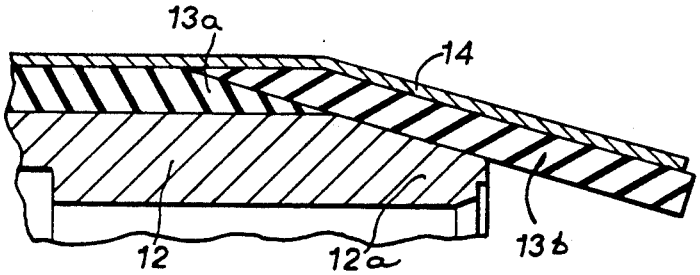

In FIG. 7 a single sheet of relatively thin conductive material is applied to most of the main body of the roller and the slope of the tapered end **12*a* to form the conductive intermediate layer 14. However, the layer 14 does not extend all the way to the end on the non-sloped end of the core. (See FIG. 16**).

Figure 8:
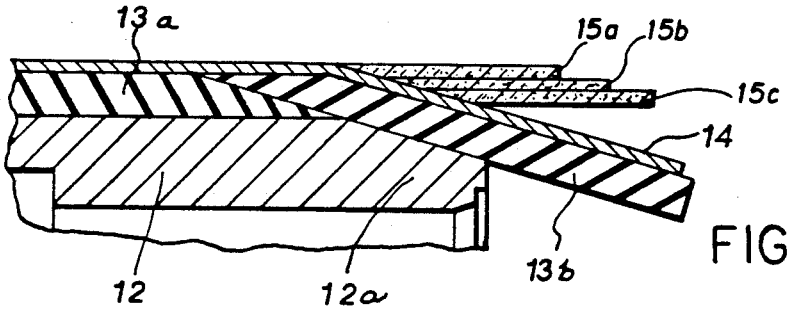
Figure 9:
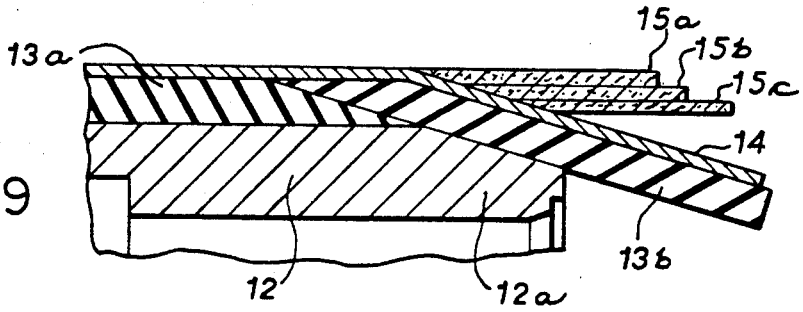

In FIGS. 8 and 9 the sloped area on the tapered end **12*a* of the core 12 is shown as built up with layers 15*a*, 15*b* and 15*c* of semiconductive material until the built up area is the same diameter as the conductive layer 14** on the main body of the roller.

Figure 10:
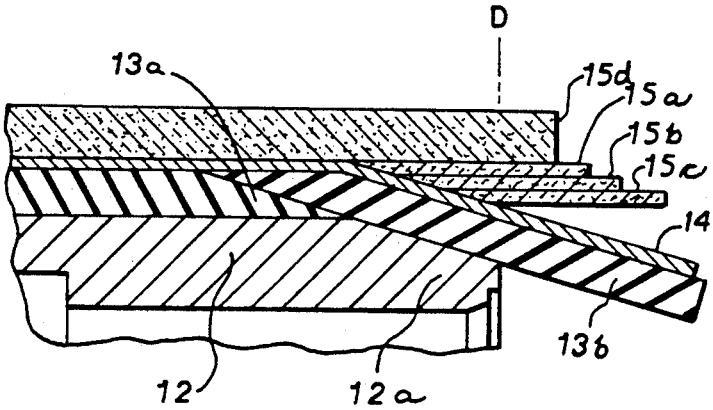

In FIG. 10 a layer **15*d*** of semiconductive material is shown covering the main body of the roller and the built up end. It is then trimmed along line D to provide an uncured roller of the proper diameter.

Figure 11:
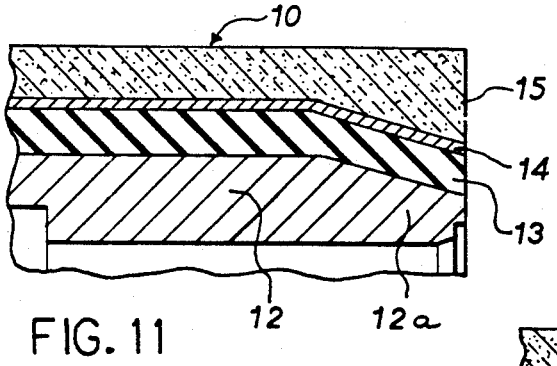

In FIG. 11 the completed tapered end of the roller 10 is shown after curing and grinding. As seen therein, the layers **15*a–d* have become a single layer 15**.

Figure 12:
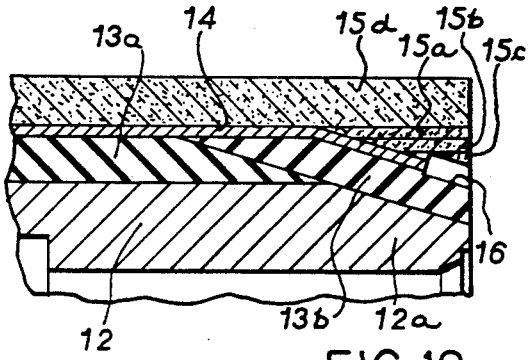
FIGS. 12 to 14 are partial views which illustrate further optional steps of the method.
Figure 13:
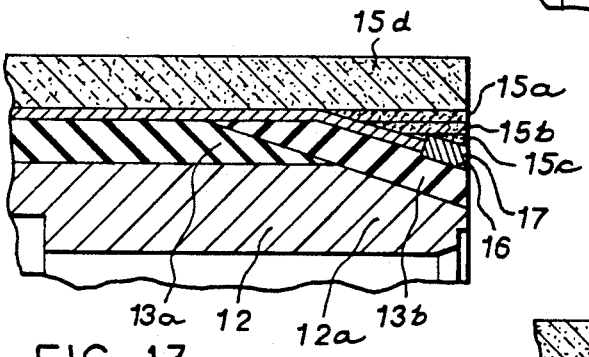
Figure 14:
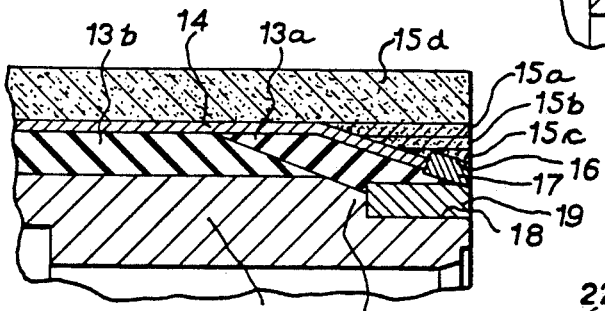

FIGS. 12, 13 and 14 show optional modifications of the first embodiment of the roller 10.

The modification of FIG. 12 is prepared as follows: A metal cutting tool is used to cut a groove 16 (seen in FIG. 12) 3.0 mm wide (0.118 inches). Some relief has to be cut in the back (end and sides) of the tool to provide clearance since it is cutting an angled circular groove. With the roller mounted on grinding plugs, centered, and rotating in a lathe, a 3.0 mm wide groove is precisely cut in the rubber covering at the proper diameter (plus or minus 0.1 mm). The depth of the groove is about 8 mm. The groove intersects the intermediate conductive layer 14 on the core 12 so that it appears at the bottom of the groove. An electrical connection can be made here to the middle layer.

FIG. 13 shows an alternative approach to providing an electrical contact area which permits a conductive layer 14 of less than 3.0 mm to be used. It is to grind the groove 16 at the proper diameter in the finished roller and fill it with a precured strip or insert 17 of 90 durometer electrically conductive rubber and to bond it in place with an electrically conductive two-part epoxy glue. Any epoxy can be used that bonds well to rubber. The material can be made electrically conductive by thoroughly dispersing about three to five percent by weight of an electrically conductive carbon black. Usually some carbon black is blended into both parts A and B of the epoxy. The blended, cured material must be no higher in resistance than the middle conductive layer 14 rubber compound, about 10^4 ohm-cm volume resistivity or lower, to provide a low resistance connection between the middle layer 14 and the precured rubber insert 17.

The precured rubber insert 17 may be the same rubber compound as the middle layer 14 on the roller 10. The insert is made to a precise thickness by fabricating it as a thin covering on a core that has no bonding agent. After curing, the rubber is ground to a thickness of about 2.85 mm so that it will fit in a 3.0 mm slot with a thin layer of epoxy on all sides. The covering is then removed from the core and cut into strips about 16 mm wide.

The strip is put into the slot in one or two pieces depending on the length of the strips available. The ends of the strips are cut on a 45 degree angle to provide better bonding of the strip ends. The strips are coated with epoxy on all sides that will contact the slot and the angle cuts on the ends. All inner surfaces of the slot are also coated with epoxy. Tape is used to hold the strips in place until the epoxy is cured. A three-hour working time epoxy can be set-up in 30 to 45 minutes if a heat lamp is placed a few inches from the roller end while it rotates slowly in a lathe.

After the epoxy is thoroughly cured (about 24 hours), the end of the roller is trimmed exactly flush with the end of the core (plus or minus 0.1 mm) using a cutting tool in a lathe. All conductive epoxy traces must be removed from the cross-sectional area to prevent short circuits from the middle layer 14 to the core 12 or surface of the roller. As a protective measure, the cross-sectional areas of the base layer 13 and semiconductive layer 15 are coated with a very thin layer (not shown) of a moisture resistant epoxy. This prevents ink (which may be somewhat electrically conductive) from penetrating the rubber in these areas.

By the described method, the exacting dimensional specifications for the roller can be easily and reliably met. Since the precured insert 17 is the same hardness as the surrounding material, and is bonded on all surfaces, it does not tend to work loose.

In FIG. 14 a core 12 is shown which has been modified so that there is now a 4 mm wide slot 18 between the core 12 and the middle conductive layer 14 in the sloped area of the core. The modified contact assembly (not shown) has a tongue that fills this slot when attached to the roller. This change lengthens the short circuit route between the middle conductive area from 4 mm to twice the depth of the slot 18. This longer path is at least 2 cm. This design can still be fabricated by the method of the present invention. The slot 18 can be tooled out after the roller is completed or the space that will eventually be the slot 18 can be filled with a metal insert 19 (as seen in FIG. 14) while the roller is being built. The insert 19 can then be removed after the roller is completed to expose the slot 18. The insert 19, which is actually a ring, can be made of steel or aluminum. It could be coated with a non-stick material on the surfaces that will contact rubber. The non-stick material could be a cured type mold release, a Teflon coating, or even thin wraps of Teflon tape.

Figure 15:
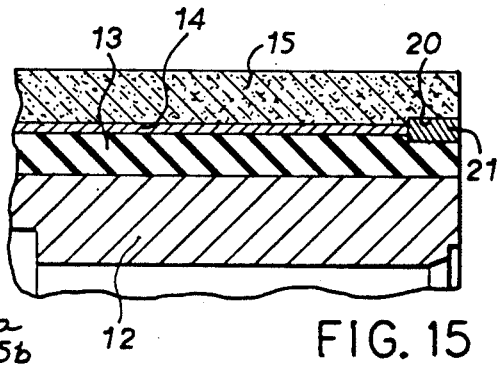
FIG. 15 is a partial view of one end of the second embodiment of the roller of the present invention.

In FIG. 15 the second embodiment of the roller of the present invention is shown. In it the core 12 is of uniform diameter and not tapered. In this embodiment, the contact area of the roller 10 has been improved by cutting an annular groove 20 into the relatively thin conductive layer 14 and filling it with an electroconductive insert 21, as described in connection with FIG. 13.

Figure 16:
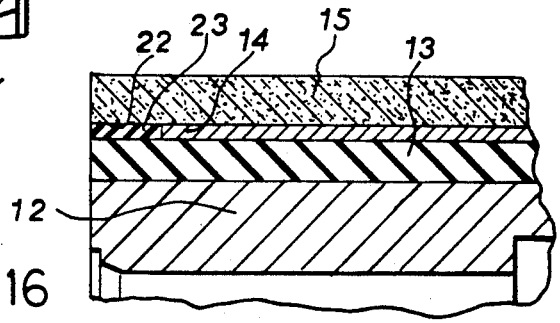
FIG. 16 is a partial view of the other end of a roller of the present invention.

Turning to FIG. 16, a partial view of the other end of the roller of the present invention is shown. As seen therein, the intermediate conductive layer 14 does not extend to the end of the core 12. A gap 22 of 1.0 to 2.5 cm is filled in with an insulator 23. Encapsulating the conductive layer 14 prevents a low resistance path that could cause arcs to ground. The other end of the roller is the same for both the first and second embodiments described.

It will be apparent to those skilled in the art that a number of modifications and changes can be made without departing from the spirit and scope of the invention. Therefore, it is intended that the invention only be limited by the claims.

I claim:

1. A method of preparing an impression roller, said method comprising:

(a) providing a steel roller core having only one tapered end;

(b) applying an insulating layer to the main body of the steel roller core so that the insulating layer covers the main body of the core but not the tapered end;

(c) trimming the end of the insulating layer on the main body adjacent the tapered end of the core to match the slope of the tapered end of the core;

(d) applying an insulating layer over the exposed slope of the tapered end of the core and trimming the insulating layer on the tapered end so that the slope of the tapered end of the core is protected by about the same thickness of insulating layer as the main body and the insulating layer on the main body and the slope mate to provide a relatively thick uninterrupted surface;

(e) applying a relatively thin conductive layer over the insulating layer on both the main body and tapered end of the roller core except for an area adjacent the untapered core end;

(f) applying layers of semiconductive material to the slope of the tapered end to build up the tapered end to the same diameter as the main body; and, (g) then applying a relatively thick semiconductive layer over the conductive layer on the main body and the built up tapered end to provide an impression roller of uniform diameter throughout its length, having an exposed conductive layer at one end and a covered conductive layer at the other end.

2. The method of claim 1 which includes:

(g) cutting an annular groove in the conductive layer at the tapered end; and, (h) filling the annular groove with an insert of electroconductive rubber and binding it in place to provide an improved contact area.

3. The method of claim 1 which includes providing the tapered end of the core with a removable insert.

4. An impression roller for an electrostatic assist system, said roller comprising:

(a) a metallic core tapered at only one end;

(b) a relatively thick insulating layer of substantially uniform thickness covering the core;

(c) an intermediate relatively thin conductive layer over the insulating layer, said conductive layer being exposed at the tapered end of the core; and (d) a relatively thick semiconductive outer layer completely covering the intermediate conductive layer except for the exposed end of the conductive layer at said one end of the roller, said outer layer being thicker over the tapered end of the core so that the outside diameter of the body of the roller is substantially uniform throughout its length.

5. An impression roller of claim 4 in which there is an annular groove in the conductive layer at the exposed end.

6. An impression roller of claim 5 in which there is a conductive insert in the annular groove.

7. An impression roller for an electrostatic assist system, said roller comprising:

(a) a metallic core;

(b) a relatively thick insulating layer of substantially uniform thickness covering the core;

(c) an intermediate relatively thin conductive layer over the insulating layer, said conductive layer being exposed at only one end of the core;

(d) a relatively thick semiconductive outer layer completely covering the intermediate conductive layer except for said one end; and, (e) an annular groove cut into said exposed end of said conductive layer and partially into the layers on each side of said conductive layer.

8. An impression roller of claim 7 in which the annular grove is filled with an insert of electroconductive material to provide an electrical contact.

* * * * *